US005394979A

United States Patent [19]

Hall et al.

[11] Patent Number: 5,394,979

[45] Date of Patent: Mar. 7, 1995

[54] HOPPER LOADER

[75] Inventors: David Hall, Plattsburgh, N.Y.; Robert Kinson, Sidney, Ohio

[73] Assignee: Prim Hall Enterprises, Inc., Plattsburgh, N.Y.

[21] Appl. No.: 71,569

[22] Filed: Jun. 3, 1993

Related U.S. Application Data

[60] Continuation-in-part of Ser. No. 978,994, Nov. 19, 1992, Pat. No. 5,310,172, which is a division of Ser. No. 693,638, Apr. 30, 1991, Pat. No. 5,197,590.

[51] Int. Cl.[6] ..... B65G 21/20

[52] U.S. Cl. ..... 198/836.3

[58] Field of Search ..... 198/836.3; 271/200, 271/240, 248, 253–255

[56] References Cited

U.S. PATENT DOCUMENTS

| | | | |
|---|---|---|---|
| 1,857,566 | 5/1932 | Perry | 198/836.3 |
| 1,877,334 | 9/1932 | Lathrop et al. | 198/836.3 |
| 2,156,020 | 4/1939 | Lathrop | 198/836.3 |
| 3,061,303 | 10/1962 | Glaser et al. | 271/240 |
| 3,389,905 | 6/1968 | Boggs | 271/240 |
| 3,527,336 | 9/1970 | Johnston | 198/836.3 |
| 3,674,258 | 7/1972 | Maier et al. | 271/200 |
| 3,858,711 | 1/1975 | Barker | 198/836.3 |
| 5,197,590 | 3/1993 | Prim et al. | 271/200 |

*Primary Examiner*—Joseph E. Valenza

*Attorney, Agent, or Firm*—Louis Weinstein

[57] ABSTRACT

A hopper loader having at least a horizontal infeed conveyor and one or a plurality of side guides each adjustable by a single operating handle to facilitate accurate horizontal product alignment over the entire length of the hopper loader. The single operating handle drives one or a plurality of linkage assemblies which operate in unison to move a guide plate slidably engaged by side edges of printed products as they move along the horizontal conveyor sections. In applications where the hopper loader incorporates conveyor sections having different angular orientations, rods and rod sections for each such conveyor section are coupled to one another by a universal joint to convey movement to each linkage under control of the single operating handle. A side guide arrangement is also provided for use with a hopper loader having an extension coupled thereto for conveying a larger quantity of signatures, the side guide assemblies of the hopper loader and the extension being operated simultaneously through the use of a single operating handle.

25 Claims, 5 Drawing Sheets

10
140'
S
CL
102
104
106
108
110
112
112a
114
114a
116
118
120
120a
122
122a
$F_2$
$A_1$
$A_2$
$A_3$
A
140

100
102
124
124a
124a-1
124a-2
124b
126
128
128a
128b
130
132
132a
132b
134
136
137
138
139
140
140a
C
$A_2$ 162b
176
184
172
182
162

10
160
184
183'
180'
181'
182'
L2
172'
177'
176'
166
G2
174
180
181
182
183
L1
172
A3
176
184
200
A2
L1
181
177
162
F
164A
164
10
164b 16
182'
180'
179'
176'
L2
170'
F'
177'
172'
166'
174
184
170
182
179
162b
L1
176
172a
177
172b
A1
172
168
F
174a
162a
162
168
166
12
14
10

HOPPER LOADER

CROSS-REFERENCE TO RELATED APPLICATIONS

This application is a continuation-in-part of U.S. application Ser. No. 978,994, filed Nov. 19, 1992, now U.S. Pat. No. 5,310,172, which is a division of U.S. application Ser. No. 693,638, filed Apr. 30, 1991, and now U.S. Pat. No. 5,197,590, issued Mar. 30, 1993.

FIELD OF THE INVENTION

The present invention relates to hopper loaders and more particularly, to a novel improved hopper loader having a unique adjustable side guide which greatly facilitates both set-up and use thereof.

BACKGROUND OF THE INVENTION

Loaders are well known to the art and are used in a variety of different segments within the fields of printing and publishing. For example, feeders are utilized to feed signatures one at a time from a hopper onto a conveyor; are used to supply signatures to a hopper; and are used to supply signatures to a signature feed assembly which, in turn, delivers partially opened signatures one at a time to a saddle conveyor, to name just a few applications. In all of the above-identified applications, it is necessary to provide signature streams and/or signature stacks which are in proper alignment to facilitate trouble-free transfer to the utilization device receiving signatures from the feeder.

In addition, when stacking signatures side-by-side preparatory to their transfer to an output utilization device, it is extremely important that the signatures be aligned so that they do not exert undue forces on the output utilization device thereby causing undesirable misfeeds.

In addition to the above, it is also important to provide feeders which not only have the versatility enabling the feeder to accommodate a variety of different signature sizes but also have the ability to permit rapid adjustment of the feeder when changing from one feeder size to another or when changing the coupling of the feeder output from one output utilization device to another.

The complicated nature and construction and the operating features of present day feeders increase the possibility of jams or other malfunctions during use and require complicated set-up operations, significantly increasing the cost of equipment as well as the cost of operating the equipment.

BRIEF DESCRIPTION OF THE INVENTION

An improved feeder which overcomes the above-mentioned disadvantages as well as providing other distinct advantages is characterized by comprising a horizontal conveyor section at the infeed for receiving signatures either manually or from an outfeed conveyor. The downstream end of the horizontal conveyor transfers signatures placed in a near-vertical orientation to an inclined ramp conveyor which typically operates at either the same or a greater linear speed than the horizontal conveyor, serving to separate the signatures and to arrange them in a shingled stream. The output end of the inclined ramp conveyor delivers the shingled stream to a short conveyor section which is typically aligned to advance the signatures delivered thereto either horizontally into a hopper or diagonally downward for insertion into any one of a variety of output utilization devices and typically oriented at an acute angle to the vertical.

Side guides are provided along the opposite parallel sides of the feeder to maintain the alignment of signatures as they move from the input to the output end thereof. Adjustable side guides are utilized to accommodate signatures of different sizes and align them with an output utilization device. A novel side guide mechanism is provided on at least one side of the feeder for adjusting a one-piece side guide extending the entire length of the feeder through a single operating handle. Two such side guide cams may be provided, one along each side of the feeder for applications in which the product register is the centerline of the machine. Alternatively, a fixed guide may be used along one side of the feeder if the fixed side of the loader is employed for product registry. The side guide cam comprises an elongated threaded assembly ("worm") comprised of linear threaded sections for each of the horizontal, ramp and output conveyor sections the adjacent ends of which are joined end-to-end by universal joints. Links pivotally coupled to threaded nuts threadedly engaging the elongated worm member are caused to pivot about a point intermediate their ends by means of a second link fixedly secured at one end to said threaded member and pivotally coupled to a point intermediate the ends of said first-mentioned coupling link. A pair of such linkages are arranged respectively near the input and output ends of the feeder and by rotation of the elongated threaded member by rotation of a crank handle the side guide may be rapidly adjusted to accommodate signatures of any size within a predetermined range thus significantly reducing set-up time.

In an alternative embodiment, the elongated threaded members are replaced by a relatively short threaded member which is utilized to drive a first linkage assembly, which first linkage assembly is coupled to another linkage assembly located downstream relative to the first linkage assembly by an elongated "push-pull" rod. This alternative embodiment eliminates the need for an elongated threaded rod and cooperating threaded members at each linkage assembly.

The aforesaid alternative embodiment is extremely advantageous for use in extending a hopper loader conveyor through the use of a conveyor extension. A hopper loader extension is coupled to the upstream end of the hopper loader. The drive coupling of the upstream end of the hopper loader is coupled to the downstream end of the extension. An operating handle of the hopper loader is removed and the downstream end of the extension push-pull road is inserted into the coupling block. The operating handle removed from the hopper loader is inserted into the female coupling of the rotating shaft of the hopper loader extension. Rotation of the drive shaft of the extension thus simultaneously adjusts the side guides of both the hopper loader and the hopper loader extension.

OBJECTS OF THE INVENTION

It is, therefore, one object of the present invention to provide a feeder which is easy to set up and may be set up preparatory to a run in a fast and simple manner.

Still another object of the present invention is to provide a feeder having novel adjustable side guides to facilitate simple, rapid adjustment thereof to accommodate different product sizes.

Still another object of the present invention is to provide a feeder having novel adjustable side guides to facilitate simple, rapid adjustment thereof to accommodate different product sizes and wherein said adjustment means utilizes a single operating handle.

Still another object of the present invention is to provide adjustable side guides for a hopper loader and a hopper loader extension which may be coupled together when using the extension to permit simultaneous adjustment of the side guides of the hopper loader and the hopper loader extension by operation of only the extension drive shaft, typically by a manually operable handle.

BRIEF DESCRIPTION OF THE FIGURES

The above, as well as other objects of the present invention, will become apparent when reading the accompanying description and drawings in which.

Figure 1:
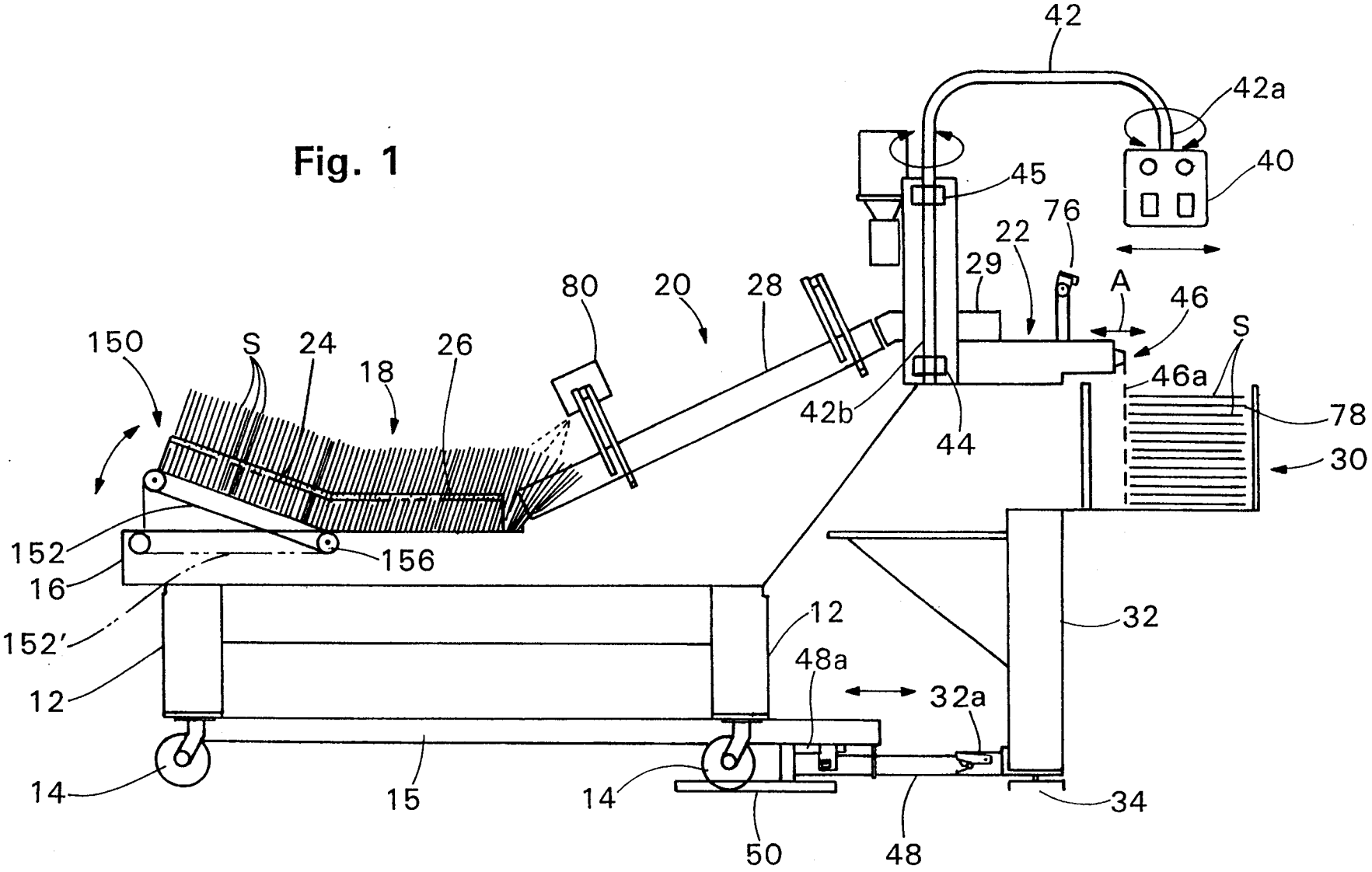
FIG. 1 shows a schematic elevational view of a feeder assembly embodying the principles of the present invention.

FIGS. *2a* and *2b* show side elevation and top plan views respectively of side guide assemblies employed in the feeder of FIG. 1;

FIG. *2c* shows an enlarged end view of the linkage assemblies employed in the side guides of FIGS. *2a* and *2b;*

FIGS. *3a* and *3b* are top and side elevational views, respectively, of another adjustable side guide embodiment of the present invention;

FIG. *3c* is a plan view of an alternative arrangement of the linkage assemblies of FIGS. *2a–3b; and*

FIGS. *4a* and *4b* are top and side elevational views respectively of a hopper loader extension for use with the hopper loader of FIGS. *3a* and *3b.*

DETAILED DESCRIPTION OF THE INVENTION

FIG. 1 shows a feeder 10 supported on four legs 12 (only two of which are shown in the Figure), each leg being provided with a caster assembly 14 for rollingly supporting feeder 10 to facilitate easy movement. The legs 12 support a frame 16 which houses the motor drives and related mechanisms for driving the horizontal conveyor section 18, the ramp conveyor section 20 and an outfeed conveyor section 22. Legs 12 are provided with manual handwheels for adjusting the height of the conveyor sections relative to hopper 30, for example. Signatures S are delivered to the horizontal conveyor section either automatically by means of an outfeed conveyor (not shown) arranged immediately adjacent the left-hand end of the conveyor section 18, or manually. As signatures are delivered to the ramp conveyor they rest against the ramp conveyor belts (only belt B being shown in FIG. 1 for purposes of simplicity) and move upwardly therealong, forming a shingled stream. The shingled stream of signatures reach and thereafter move along the conveyor belts of the outfeed conveyor section 22. Each signature moves off of the outfeed conveyor section 22 and falls into a hopper 30 coupled to feeder 10. The hopper 30 is provided with a support 32 mounted upon the floor and preferably precisely located thereon by a positioning pin (or pins) 34 (FIG. 1*c*), such as a lag bolt, which facilitates accurate positioning of the hopper and the feeder coupled thereto in a manner to be more fully described.

The signatures fall into hopper 30 oriented in a substantially horizontal plane. The hopper delivers signatures in a one-at-a-time fashion into an output utilization device (not shown). In order to assure proper signature feeding from hopper 30 it is important to form a neat signature stack therein. The alignment of signatures within the feeder and the adjustment of the feeder relative to the hopper significantly contribute to accurate, error-free operation and it is important to provide apparatus which assures the desired alignment and positioning of components as well as guidance of the signatures throughout the feeding and stacking operation. For example, the feeder 10 is provided with side guides including side guide sections 24, 26, 28 and 29 which are provided along opposite longitudinal sides of the feeder, the side guides of only one side of the feeder being visible in FIG. 1, the side guides assuring proper alignment of the signatures in the horizontal plane and within hopper 30. Adjustable side guides are provided as will be described more fully hereinbelow in order to accurately align the signatures in the feeder relative to the output hopper as well as greatly facilitating set-up of the feeder when changing to a different product size.

The feeder is provided with a control panel 40 having a variety of control buttons and displays. The control panel is easily accessible from one side of the feeder as shown in FIG. 1 as well as the top plan view shown in FIG. 1*a.* The control panel 40 is mounted to the free or right-hand end 42*a* of a rotating control arm or boom 42 having an inverted J-shape which has its lower left-hand end 42*b* rotatably mounted within a cup assembly 44. A pivot coupling 45 rotatably mounts an upper portion of section 42*b.* Control panel 40 is rotatably coupled to the end 42*a* of boom 42 by means of a bearing assembly 43 (not shown in detail) arranged within the upper portion of the control panel housing.

Summarizing, the lower end of boom 42 fits within a pivot cup 44 having a suitable bearing for rotatably mounting boom 42 therein. A pivot block 45 is mounted along the machine frame a spaced distance above pivot cup 44. The lower end of boom 42*b* pivots within suitable bearing means in pivot cup 44. A pivot block 45 arranged a spaced distance above pivot cup 44 provides a similar bearing assembly and cooperates with pivot cup 44 to prevent any movement by boom 42 other than about its longitudinal vertical axis.

FIGS. *2a, 2b* and *2c* respectively show the side elevation, top plan view and end view of the novel side guide assembly utilized in the feeder 10.

The preferred embodiment of the side guide assembly 100 is comprised of a one-piece side guide 102 of a shape conforming to the shape of the sections 18, 20 and 22. A pair of supporting blocks 104 and 106 are directly secured to side guide 102 by suitable fastening means F. A linkage arm 108, 110 is pivotally coupled to an associated one of the mounting blocks 104, 106 by a fastener F1 which threadedly engages each of the arms 108, 110 while extending through a clearance opening in each block 104 and 106. The clearance opening 104*a* is shown for block 104 in FIG. 2*c.*

The opposite end of each of the arms 108, 110 is pivotally coupled to threaded nuts 112, 114 by pin means 112*a,* 114*a.*

Figure 2B:
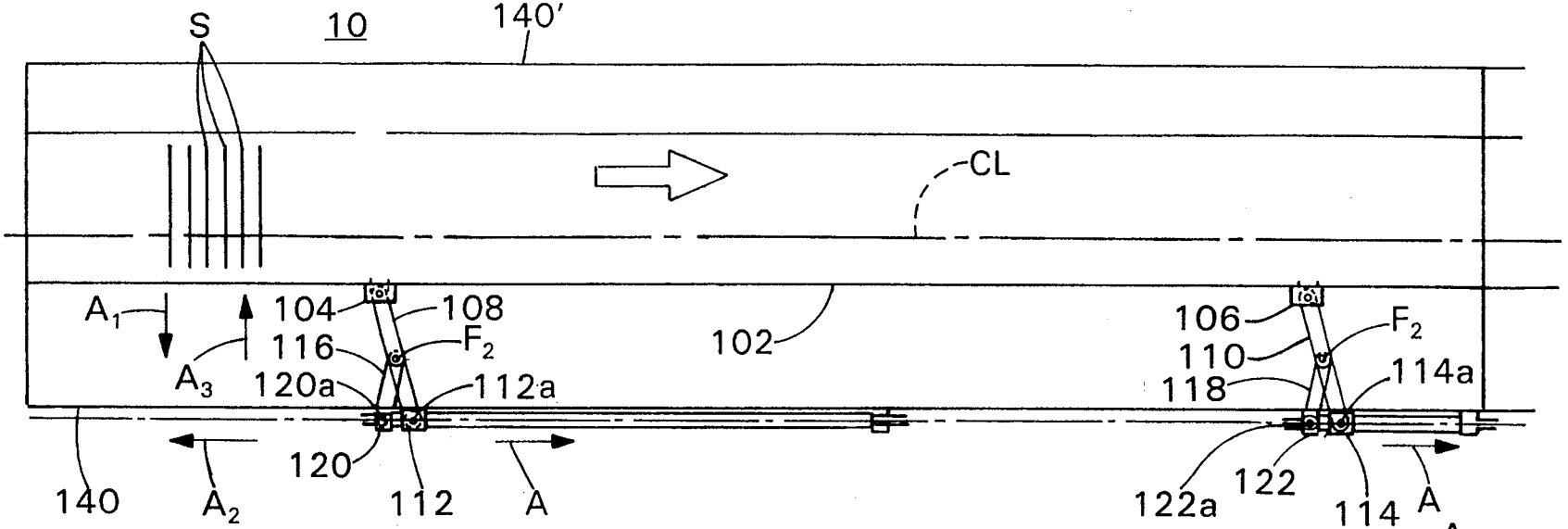
Figure 2A:
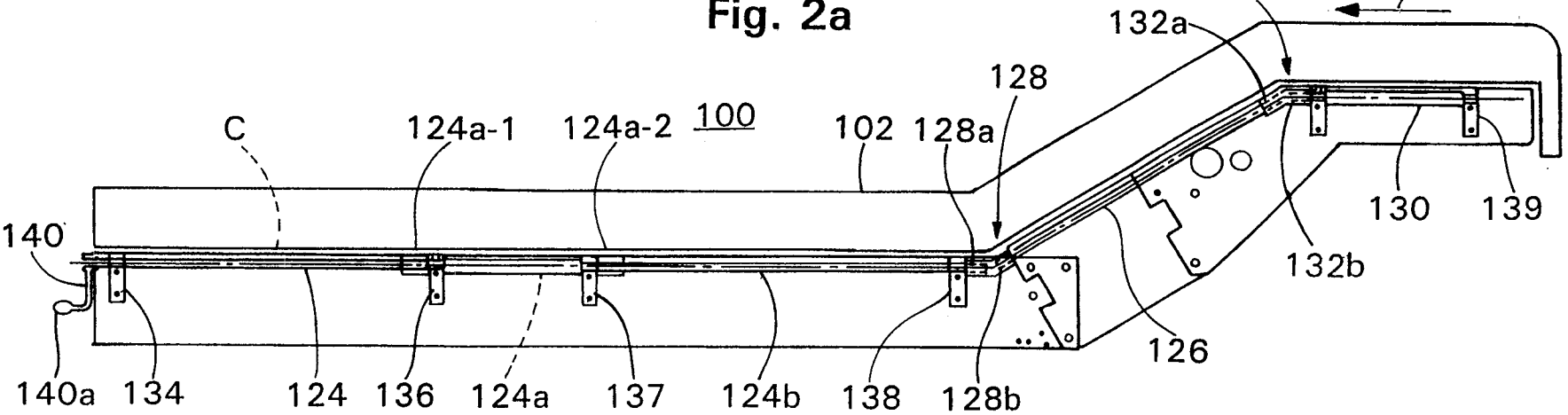
Figure 2C:
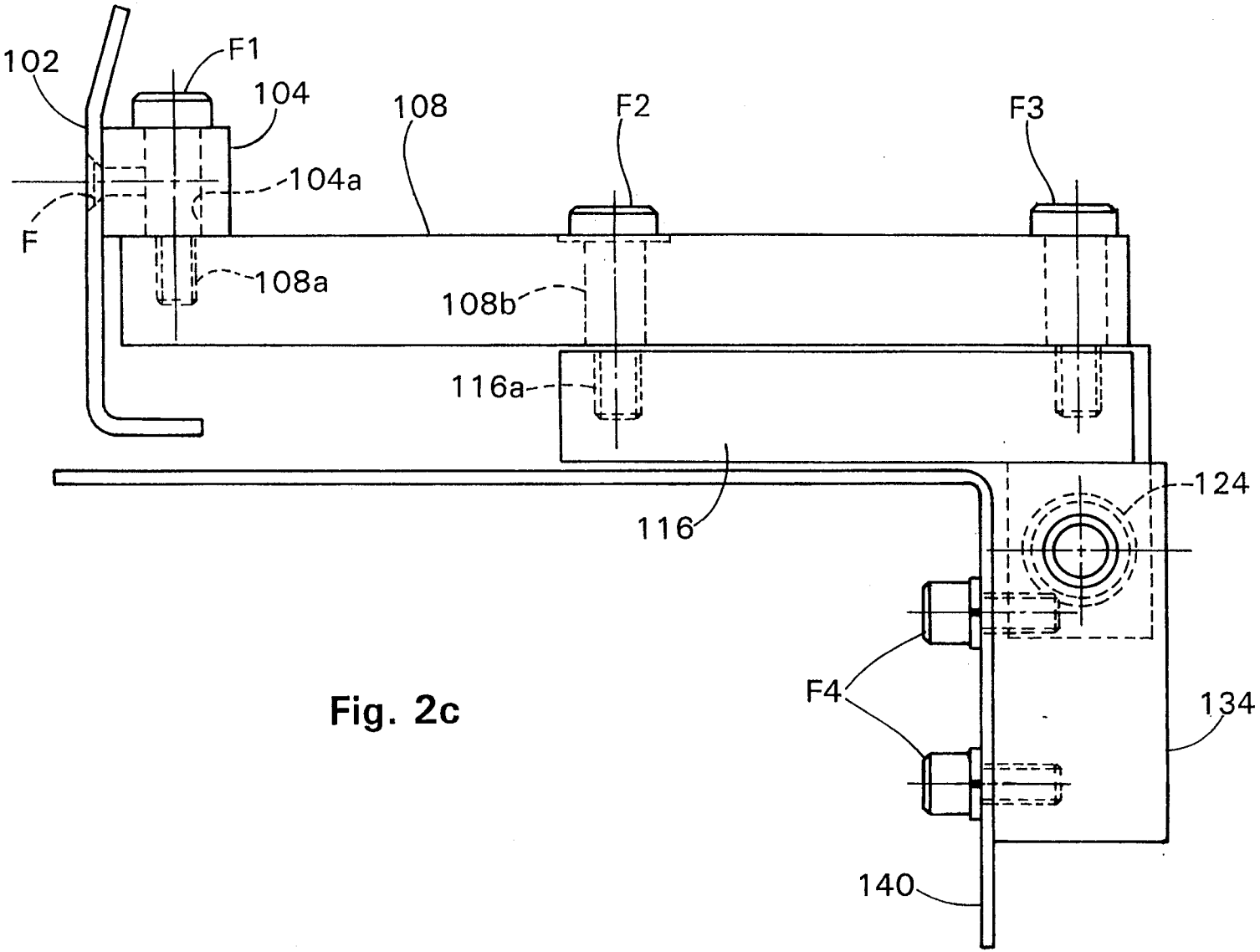

The intermediate portion of each arm 108, 110 is pivotally coupled to a short arm 116, 118 by means of a fastener F2 extending through a clearance opening in each arm 108 and 110 and threadedly engaging a tapped aperture in each of the arms 116 and 118. FIG. 2*c* shows fastener F2 extending through a clearance opening 108*b* in arm 108 and threadedly engaging an opening in arm 116. The opposite ends of each of the arms 116, 118 is pivotally coupled to a block 120, 122 by suitable pin means 120*a*, 122*a* respectively. Blocks 120 and 122 are fixedly secured to support frame 140. An elongated drive assembly, provided with threaded portions only where needed, is comprised of a first elongated member 124, and a second shorter threaded member 124*a* having its left-hand end 124*a*-1 coupled to the right-hand end of member 124. The right-hand end 124*a*-2 of threaded member 124*a* is coupled to the left-hand end of rod 124*b*. The right-hand end of rod 124*b* is coupled to the left-hand end 128*a* of universal joint 128. The right-hand end 128*b* of universal joint 128 is coupled to the left-hand end of rod 126. The right-hand end of rod 126 is coupled to the left-hand end 132*a* of universal joint 132. The right-hand end of 132*b* of universal joint 132 is coupled to the left-hand end of threaded rod 130. In the embodiment of FIGS. 2*a*–2*c* only two threaded portions are provided. The number of threaded portions are a function of the number of linkage assemblies employed. Bracket 139 serves as a bearing rotatably supporting the right-hand end of threaded member 130.

Member 124 is rotatably mounted, i.e. is mounted to rotate about its longitudinal axis represented by dotted centerline C, by means of clamps 134, 136, 137 and 138 fixedly secured to side wall 140, forming part of the support frame of feeder 10, by fasteners F4 (see FIG. 2*c*). The threaded sections 124*a* and 130 also extend through guide openings in blocks 120 and 122.

Members 112 and 114 are provided with tapped openings which threadedly engage threaded members 124 and 130, respectively.

An operating handle comprised of hand crank 140 is fixedly secured to the left-hand end of threaded member 124 and a rotatable handle portion 140*a* is utilized to rotate threaded members 124, 126 and 130. The operation of adjustable side guide is as follows:

By rotating operating handle 140 in a first direction, threaded blocks 112 and 114 are caused to move in the direction shown by arrow A causing members 108 and 110 to rotate counterclockwise about fasteners F2 thereby moving one-piece adjustable side guide 102 in a direction shown by arrow A1. Rotating the hand crank in the opposite direction causes threaded members 112 and 114 to move in the directions shown by arrows A2 causing arms 108 and 110 to rotate clockwise about pivots F2 thereby moving side guide 102 in a direction shown by arrow A3.

In applications wherein the centerline of the machine represented by dotted line CL is utilized for product registry of the feeder and cooperating hopper, a similar side guide assembly may be utilized along the opposite side 140' of the feeder 10. However, if side 140' of the feeder 10 serves as the product registry, a fixed guide may be employed along side 140'. It can thus be seen that the side guide (or guides) may be adjusted through operation of a single operating handle to both fine-tune the alignment of the signatures relative to the receiving hopper as well as adjusting the side guides when undertaking a product run requiring a change in product size.

Figures 3A, 3B, 3C:
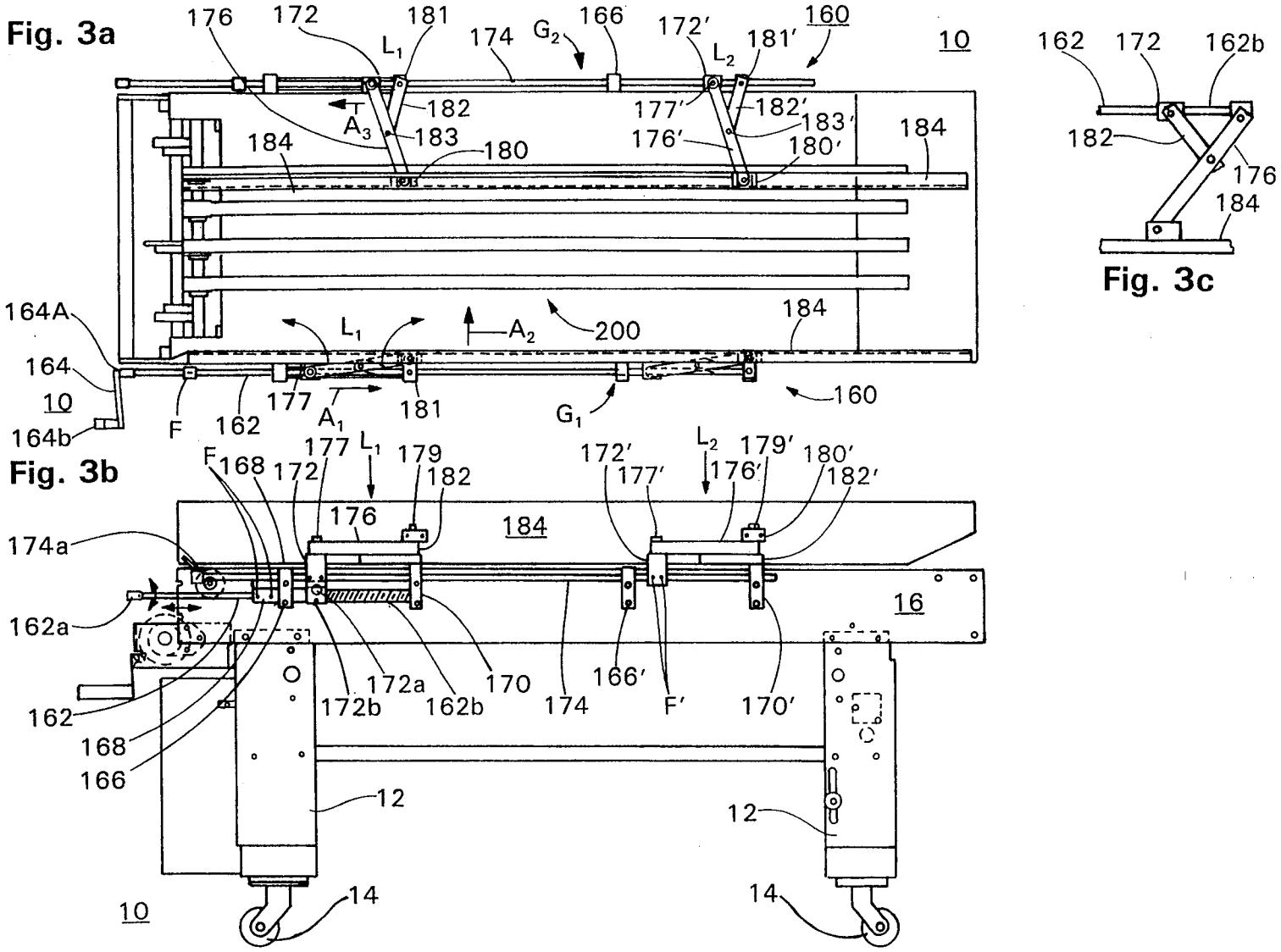

Another alternative embodiment of a side guide assembly as shown in FIGS. 3*a* and 3*b* in which a pair of alternative side guide assemblies G1, G2 are arranged along opposite sides of the hopper loader 10.

Both side guide assemblies are substantially identical to one another except that they are mirror images of one another. The side guide assemblies are each comprised of an elongated rod 162 whose right-hand end extends through a bore in block 168 and is secured to block 168 by fasteners F. The left-hand end of rod 162 is provided with an opening of a non-circular shape such as, for example, rectangular, hexagonal, etc. for releasably receiving a male member having a conforming cross-sectional shape provided at end 164*a* of manually operable hand crank 164 provided with a handle 164*b* for rotating crank 164 and hence rod 162.

Rod 162 extends through block 168 and a bore provided in guide block 166 and has a threaded rod portion 162*b* which threadedly engages a tapped opening provided in elongated block 172. The right-hand end of threaded rod portion 162*b* terminates in a bearing or support 170*a* provided in block 170. Blocks 166 and 170 are secured to hopper frame 16.

Rotation of rod 162 causes rotation of threaded rod portion 162*b* which, for example, when rotated in a clockwise direction, causes block 172 to move to the right and when rotated in a counterclockwise direction causes block 172 to move to the left.

An elongated push-pull rod 174 is provided with an enlarged head 174*a* at its left-hand end and extends through a guide bore provided in guide block 166, and a bore provided in block 172 and further extends through a guide bore provided in block 170. Push-pull rod 174 is free to move relative to guide block 166 and block 170 but is securely fastened to block 172 so as to cause push-pull rod 174 to move when block 172 is moved due to the rotation of threaded rod portion 162*b*. Guide blocks 166 and 170 cooperate with rod 174 and rod 162 to maintain the proper orientation of block 172 as it is moved back and forth.

A first linkage assembly L1 comprises an elongated linkage arm 176 which has its left end pivotally secured to the top of block 172 by a pivot pin 177. The right-hand end of linkage arm 176 is pivotally secured to a pivot pin 179 which extends through a bore in mounting bracket 180 and extends into and is pivotally coupled to linkage arm 176. Mounting bracket 179 is secured to guide plate 184 which is slidably engaged along its inner surface by signatures as they advance along conveyor means 200.

A short linkage arm 182 has its right-hand end coupled to the top of block 170 by means of pivot pin 181. The left-hand end of short linkage arm 182 is pivotally coupled to a point intermediate the ends of linkage arm 176 by pivot pin 183. Bracket 180 is secured to elongated guide plate 184. Linkage arms 176 and 182 constitute the drive means for moving guide plate 184 to the desired position according to the width of signatures being handled.

A similar linkage assembly L2 of linkage arms located downstream of linkage assembly L1 is comprised of linkage arms 176' and 182', which operate in a manner substantially identical to linkage arms 176 and 182. The blocks which these linkage arms are coupled to and the pivot pins are identified by the same designating numerals as the upstream linkage assembly L1 with the exception that each designating numeral carries a "prime" to differentiate between the two linkage assemblies L1 and L2.

More particularly, guide block 166', secured to hopper loader frame 16, is similar to guide block 166 except that the need for guiding the rotating drive rod 162 is eliminated. Hence, guide block 166' simply guides freely movable push-pull rod 174. Block 172' is provided with a bore for receiving push-pull rod 174 and with fasteners F' for securing block 172' to push-pull rod 174. Block 172' is reduced in vertical length since the need for a threaded rod portion 162*b* is eliminated, due to the novel arrangement of the alternative embodiment of FIGS. 3*a* and 3*b*.

Block 170' is secured to frame 16 and is provided with an opening for slidably guiding push-pull rod 174. The need for a bearing provided in the lower end of block 170' for supporting a threaded rod portion is eliminated since the threaded rod portion has been eliminated due to the use of the novel push-pull rod 174 whose operation will now be described.

The manner of operation of the side guide assembly is as follows:

FIG. 3*a* shows side guide assembly G1 in the position to accept the widest possible signatures whereas side-guide assembly G2 is in the position to accept the signatures of narrowest width.

Assuming that the guide plate 184 of assembly G1 is to moved so as to occupy the mirror image of the position occupied by side guide assembly G2 to accommodate narrow width signatures, in order to accomplish this, hand crank 164 is mounted to rotatable rod 162 and is rotated in the clockwise direction, causing block 172 having a tapped opening threadedly engaging threaded rod portion 162*b*, to be moved toward the right as shown by arrow A1 in FIG. 3*a*. Block 170 is maintained stationary due to the fact that it is securely fastened to stationary side wall 16 of hopper loader 10. Thus, long linkage arm 176 rotates in the counterclockwise direction about pivot 177 (see FIG. 3*a*) and simultaneously therewith short linkage arm 182 rotates in the clockwise direction about pivot pin 181 whereby the right-hand end of long linkage arm 176 moves side guide plate 184 toward the central longitudinal axis of the hopper loader 10 in the direction shown by farrow A2.

The movement of block 172 is imparted to rod push-pull rod 174 causing rod 174 to move in the direction shown by arrow A1. This movement is imparted to block 172' causing linkage arms 176' and 182' to move in a manner substantially identical to the movement of linkage arms 176 and 182. This movement is imparted to elongated side guide plate 184 causing guide plate 184 to move so that its longitudinal orientation is always parallel to the original position of plate 184 of the side guide assembly G1. Plate 184 may assume an infinite number of positions between the limit positions shown by plate 184 of assembly G1 and plate 184 of assembly G2. The movement of plate 184 in the longitudinal direction due to the swinging movement of linkage arm 176 is offset by the linear movement of linkage arm 176 in the opposite direction whereby the resultant movement of guide plate 184 is only in the transverse direction.

The side guide plates 184, 184 may be arranged so that they are equidistant from a longitudinal centerline of the hopper loader 10 or may be arranged in any other fashion. As a further alternative, one of the side guide assemblies G1 and G2 may be totally eliminated and replaced by a stationary side guide as was described hereinabove in connection with the embodiment of FIGS. 2*a*–2*c*.

In applications where it is desired to move the side guide assembly from the position shown by assembly G2 to or toward the position shown by assembly G1, the rotatable drive arm 162 is rotated in the counterclockwise direction causing the block 172 containing a tapped opening threadedly engaging threaded rod portion 162*b* to move in the direction shown by arrow A3. The movement of block 172 is imparted to push-pull rod 174 causing block 172' which is securely fastened to push-pull rod 174 to likewise move in the direction shown by arrow A3.

Both linkage assemblies L1 and L2 thus move in unison thereby moving the side guide plate 184 from the position occupied by the plate 184 in side guide assembly G2 toward the outermost position as represented by plate 184 of the side guide assembly G1. Again it will be noted that the side guide plate 184 moves so that its spatial orientation does not change. More particularly, side guide plate 184 remains parallel to previous positions occupied by the plate in moving from the innermost position to the outermost position.

The need for an elongated threaded rod extending the length of the adjustable side guide assembly G1 and G2 is eliminated through the unique employment of the push-pull rod 174.

Although only two linkage assemblies have been provided, it is understood that a greater number may be employed, especially in applications wherein the hopper loader 10 is of a greater longitudinal length.

Figure 4A:
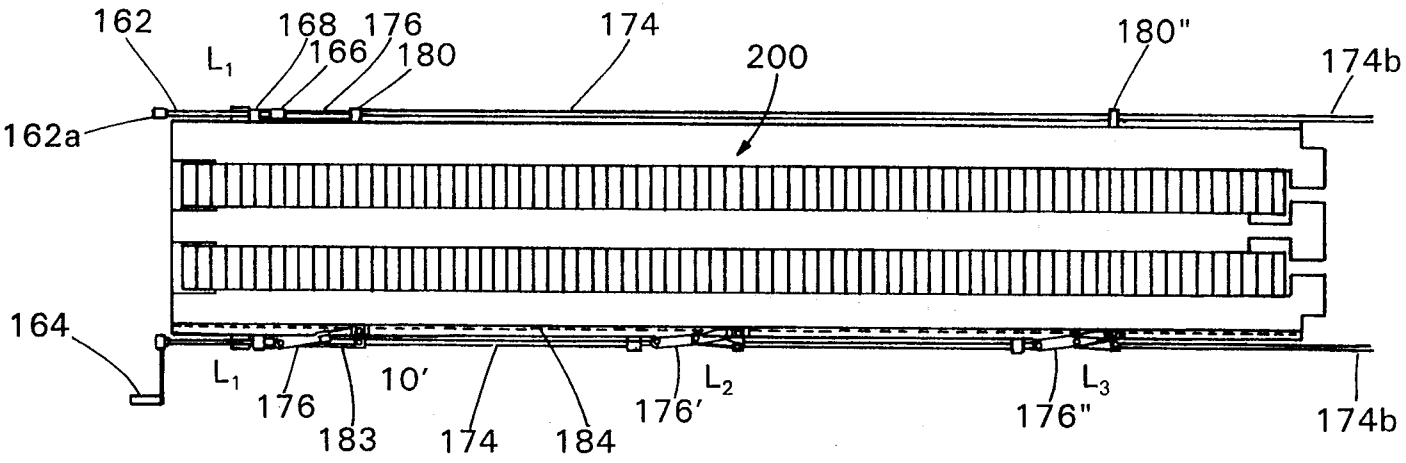
Figure 4B:
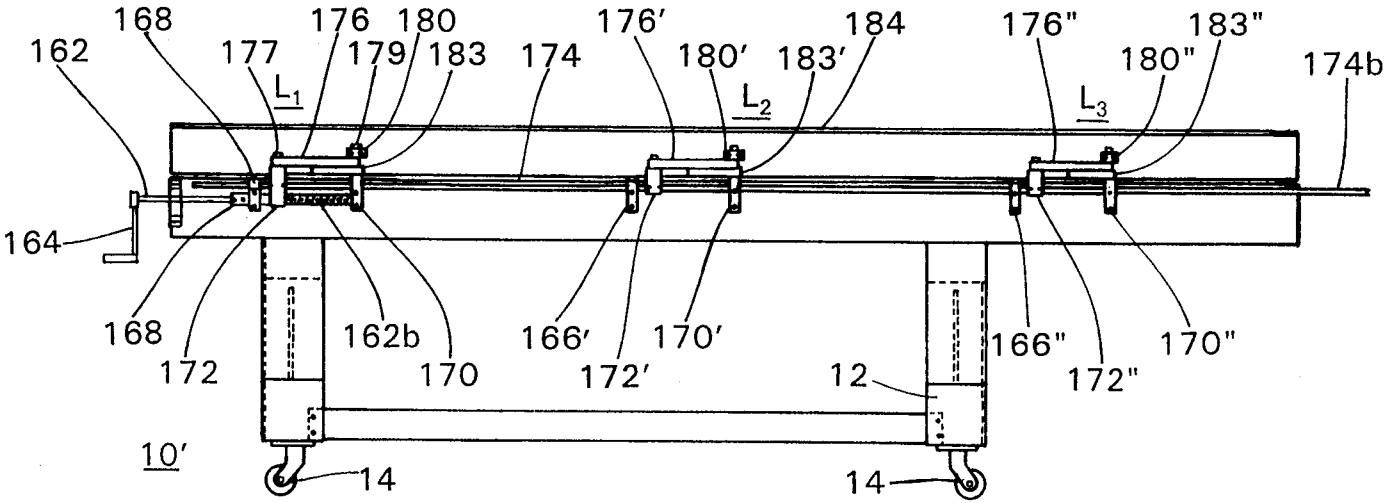

In applications where it is desired to provide a longer, horizontally aligned hopper loader to accommodate a larger number of signatures, a hopper loader extension shown in FIGS. 4*a* and 4*b* may be coupled to the hopper loader shown in FIGS. 3*a* and 3*b*.

The extension 10' shown in FIGS. 4*a* and 4*b* is substantially identical to the hopper loader 10 of FIGS. 3*a* and 3*b* wherein like elements are designated by like numerals.

The following are the distinctions between hopper loader 10 and extension 10':

(a) The push-pull rods 174 of extension 10' extend beyond the right-hand end of extension 10' for coupling to the left-hand ends of the push-pull rods 174 of hopper loader 10.

(b) Hopper loader 10 is provided with a pin 172*a* to disconnect the lower block portion 172*b* from the main block portion 172.

(c) Member 174*a* at the left-hand end of each push-pull rod 174 of the hopper loader 10 is provided with an opening at its left-hand end to receive the right-hand end 174*b* of the push-pull rods 174 of extension 10'. A threaded fastener F secures each push-pull rod 174 of extension 10' to an associated push-pull rod 174 of hopper loader 10.

(d) Coupling members (not shown) are provided to couple the drive for the conveyor 200 of hopper loader 10 to conveyor 200 of the extension 10' so that the conveyors move at the same speed under control of a single drive means.

Operation of the hopper loader 10 combined with extension 10' is as follows:

The right-hand (i.e. downstream) end of extension 10' is moved against and aligned with the left-hand (i.e. upstream) end of hopper loader 10.

The coupling assembly (not shown) is employed to couple drive for conveyor 200 of hopper loader 10 to the conveyor 200 of extension 10'.

The hand crank 164 is removed from the hopper loader 10 for subsequent use with the extension 10'.

The right-hand ends 174*b* of the extension push-pull rods are each inserted into the left-hand ends of one of the coupling blocks 174*a* and the fasteners F are tightened to secure the push-pull rods of loader 10 and extension 10' to one another.

Pin 172*a* is removed from each main block 172 at the upstream end of hopper loader 10, releasing each lower block 172*b* from its main block 172 permitting main blocks 172 to freely move.

By inserting operating handle 164 into the left-hand end of drive member 162 of extension 10' and rotating the operating handle, the rotation of threaded member 162*b* in extension 10' moves block 172, which movement is imparted to push-pull rod 174 of extension 10'. This movement is imparted to each linkage assembly L1, L2 and L3 of extension 10' and L1 and L2 of hopper loader 10, enabling adjustment of the side guides of hopper 10 and extension 10' through the operation of a single operating handle.

It can thus be seen that the novel saddle hopper feedrack assembly of the present invention greatly simplifies the coupling of the saddle stitcher to a feeder for automatic operation which set up is significantly easier and faster than the feedracks of conventional design and which further permits simple and rapid set-up of the feedrack for manual loading.

A latitude of modification, change and substitution is intended in the foregoing disclosure, and in some instances, some features of the invention will be employed without a corresponding use of other features. For example, the linkage arms 176, 182 of FIGS. 3*a*, 3*b* may be reversed in the manner shown in FIG. 3*c*. The arm 182 is thus driven by tapped block 172. This reversal may also be employed in the embodiment of FIGS. 21–2*c*. Accordingly, it is appropriate that the appended claims be construed broadly and in a manner consistent with the spirit and scope of the invention herein described.

What is claimed is:

1. Means for conveying signatures to an output utilization device comprising:

conveyor means for receiving signatures thereon and moving the received signatures toward said output utilization device;

a support frame for supporting said conveyor means;

elongated side guides arranged on opposite parallel sides of said conveyor means for limiting lateral movement of signatures as they move along said conveyor means;

at least one of said side guides comprising an adjustable guide assembly;

said adjustable guide assembly comprising plural adjustment means mounted at spaced intervals along said support frame and each having a threaded driven member for moving said at least one side guide only in a direction which lies in a plane transverse to a direction of movement of signatures along said conveyor means while maintaining said at least one side guide parallel to a longitudinal centerline of said conveyor means; and said adjustable guide assembly including single rotatable drive shaft means arranged parallel to said centerline and threadedly engaging said driven members for simultaneously moving the driven members of all of said adjustment means along an axis of said drive shaft means to adjust a distance of said side guide relative to said centerline.

2. The conveying means of claim 1 comprising:

elongated drive means mounted for rotation about its longitudinal axis along said support frame and having threaded portions at spaced intervals;

first and second pivot arms each having a first end pivotally coupled to said support frame at spaced locations thereon;

first and second coupling arms each having a first end pivotally connected to said guide at spaced intervals thereon;

a second end of each of said coupling arms being pivotally coupled to tapped members each threadedly engaging a threaded portion of said elongated drive means;

each of said pivot arms having a pivotal pin a spaced distance from said first end of said pivot arm, said pivot pin being pivotally coupled to an associated one of said coupling arms at a location intermediate the first and second ends of said coupling arms; and said drive means comprising manually operable means being coupled to one end of said elongated drive means for rotating said elongated drive means about its longitudinal axis causing said first and second tapped members to be moved along their associated threaded portions thereby pivoting their associated coupling arm whereby said side guide is moved relative to said support frame.

3. The conveying means of claim 2 wherein said conveyor means has a conveyor path comprised of a first substantially horizontally aligned path portion, a second inclined path portion arranged at the downstream end of said first horizontally aligned path portion, and a third path portion arranged at the downstream end of said inclined path portion and being a spaced distance above the first horizontally aligned path portion; and said side guide being an elongated one-piece member having a shape conforming to said conveyor path comprising said first, second and third path portions.

4. The conveying means of claim 3 wherein said elongated drive means is comprised of a plurality of elongated rod-like sections each of a length substantially equal to the length of said first, second and third path portions respectively; and plural universal joint means pivotally coupling adjacent ends of said rod-like members, said universal joint means coupling rotation of said manually operable means to all of said elongated rod-like sections to rotate in unison about their respective longitudinal axes.

5. The conveying means of claim 1 wherein said adjustable side guide is provided along one side of said conveyor means and fixed guide means is provided along the opposite side of said conveyor means.

6. The conveying means of claim 1 wherein first and second adjustable side guides are provided on opposite sides of said conveyor means.

7. Means for conveying signatures to an output utilization device comprising:

conveyor means for receiving signatures thereon and moving the received signatures toward said output utilization device;

a support frame for supporting said conveyor means;

elongated side guides arranged on opposite parallel sides of said conveyor means for limiting lateral movement of signatures as they move along said conveyor means;

at least one of said side guides comprising an adjustable guide assembly;

said adjustable guide assembly comprising plural adjustment means mounted at spaced intervals along said support frame and each having a threaded driven member for moving said at least one side guide only in a direction which lies in a plane transverse to a direction of movement of signatures along said conveyor means while maintaining said at least one side guide parallel to a longitudinal centerline of said conveyor means;

said adjustable guide assembly including single rotatable drive shaft means arranged parallel to said centerline and threadedly engaging said driven members for simultaneously moving the driven members of all of said adjustment means along an axis of said drive shaft means to adjust a distance of said side guide relative to said centerline; and said drive means comprising a plurality of rods connected end-to-end, selected ones of said rods having threaded portions for driving a tapped member of an associated adjustment means.

8. Means for conveying signatures to an output utilization device comprising:

conveyor means for receiving signatures thereon and moving the received signatures toward said output utilization device;

a support frame for supporting said conveyor means;

at least one side guide assembly arranged along one side of said conveyor means for limiting lateral movement of signatures as they move along said conveyor means;

said adjustable side guide assembly comprising a guide plate and plural adjustment means coupled between said support frame and said guide plate for selectively moving said guide plate only in a direction transverse to a direction of movement of signatures along said conveyor means while maintaining said guide plate parallel to a longitudinal centerline of said conveyor means;

said adjustable guide assembly including single manually operable rod means aligned parallel to said centerline for moving said adjustment means to adjust a position of said guide plate; and said manually operable rod means including a rotatably mounted rod having a threaded portion; and tapped means threadedly engaging said threaded portion and movable along said threaded rod for moving said adjustment means.

9. Means for conveying signatures to an output utilization device comprising:

conveyor means for receiving signatures thereon and moving the received signatures toward said output utilization device;

a support frame for supporting said conveyor means;

at least one side guide assembly arranged along one side of said conveyor means for limiting lateral movement of signatures as they move along said conveyor means;

said adjustable side guide assembly comprising a guide plate and plural adjustment means coupled between said support frame and said guide plate for selectively moving said guide plate only in a direction transverse to a direction of movement of signatures along said conveyor means while maintaining said guide plate parallel to a longitudinal centerline of said conveyor means;

said adjustable guide assembly including single manually operable rod means aligned parallel to said centerline for moving said adjustment means to adjust a position of said guide plate; and said manually operable rod means comprising a threaded rod engaging a tapped aperture in a longitudinally movable block, one of said adjustment means being pivotally coupled to said movable block for adjusting a distance of said guide plate from said centerline.

10. The conveying means of claim 9 further comprising second adjustment means coupled to said guide plate;

linearly movable rod means coupled to said first-mentioned adjustment means for moving the second adjustment means responsive to movement of said movable block for adjusting a distance of said guide plate relative to said centerline.

11. Means for conveying signatures to an output utilization device comprising:

conveyor means for receiving signatures thereon and moving the received signatures toward said output utilization device;

a support frame for supporting said conveyor means;

an adjustable side guide assembly arranged along one longitudinal side of said conveyor means for limiting lateral movement of signatures as they move along said conveyor means;

said adjustable guide assembly comprising an elongated guide plate for slidably engaging side edges of signatures as they move along said conveyor means;

at least a pair of adjustment means coupled between said support frame and said guide plate for adjusting a distance of said guide plate relative to a centerline of said conveyor means while maintaining said guide plate parallel to said centerline;

drive rod means rotatably mounted to said support frame parallel to said longitudinal side; and tapped drive means threadedly engaging a threaded portion of said rotatably mounted drive rod means for moving at least one of said adjustment means to adjust a distance of the guide plate relative to the centerline of the conveyor means.

12. The conveying means of claim 11 wherein said adjustment means comprises first and second linkage arms, a first end of said first arm being pivotally connected to said drive means and a second end of said first arm being pivotally coupled to said guide plate;

a first end of said second arm being coupled to said support frame and having a pivot pin arranged a spaced distance from the first end of said second arm; and said pivot pin being coupled to said first arm at a point intermediate its first and second ends to pivotally couple said first and second arms whereby said adjustment means adjusts the position of said guide plate responsive to movement of said drive means.

13. The conveying means of claim 11 wherein said adjustment means comprises first and second linkage arms, a first end of said first arm being pivotally connected to said support frame and a second end of said first arm being pivotally coupled to said guide plate;

a first end of said second arm being coupled to said drive means and having a pivot pin arranged a spaced distance from the first end of said second arm; and said pivot pin being coupled to said first arm at a point intermediate its first and second ends to pivotally couple said first and second arms whereby said adjustment means adjusts the position of said guide plate responsive to movement of said drive means.

14. The conveying means of claim 12 wherein a first one of said adjustment means is coupled to said drive means; and elongated rod means coupled to said drive means for moving the second adjustment means responsive to movement of said drive means.

15. The conveying means of claim 11 wherein said rotatably mounted member comprises a threaded portion threadedly engaging a movable, tapped, drive means;

a first linkage arm having a first end pivotally coupled to said drive means and a second end pivotally coupled to said guide plate;

a second linkage arm having a first end pivotally coupled to said support frame; and pivot means coupled to said second linkage arm at a location a spaced distance from the first end of said second linkage arm and coupled to said first linkage arm at a location intermediate the first and second ends of said first linkage arm for pivotally coupling said first and second linkage arms whereby movement of said drive means controls movement of said guide plate.

16. The conveying means of claim 11 wherein said second adjustment means comprises:

a first linkage arm having a first end pivotally coupled to a second drive means and a second end pivotally coupled to said guide plate;

a second linkage arm having a first end pivotally coupled to said support frame;

pivot means coupled to said second linkage arm at a location a spaced distance from the first end of said second linkage arm and coupled to said first linkage arm at a location intermediate the first and second ends of said first linkage arm for pivotally coupling said first and second linkage arms whereby movement of said drive means controls movement of said guide plate; and a coupling rod being coupled between the drive means of said second adjustment means and the drive means of the first adjustment means whereby said first and second adjustment means are moved substantially simultaneously to adjust the position of the guide plate.

17. The conveying means of claim 16 wherein the first end of said second linkage arm of said first and second adjustment means are each coupled to the conveyor means support frame by an associated support bracket.

18. The conveying means of claim 16 further comprising:

bracket means included in said first and second adjustment means and each being provided with guideways for guiding and supporting said coupling rod.

19. Means for conveying signatures to an output utilization device comprising:

first and second conveyor means for receiving signatures thereon and moving the received signatures toward said output utilization device;

a separate support frame for supporting each of said first and second conveyor means;

at least one side guide assembly arranged along one side of each of said conveyor means for limiting lateral movement of signatures as they move along said conveyor means;

said adjustable side guide assembly comprising a guide plate and adjustment means coupled between said support frame and said guide plate for selectively moving said guide plate only in a direction which lies in a plane transverse to a direction of movement of signatures along said conveyor means; and said adjustable side guide assembly including single rotatable drive shaft means for moving said adjustment means to adjust a position of said guide plate while maintaining said guide plate parallel to a longitudinal centerline of at least one of said conveyor means;

said first and second conveyor means being arranged with a downstream end of said first conveyor means positioned adjacent an upstream end of said first and second conveyor means;

manually operable means being coupled to an upstream end of said drive shaft means at an upstream end of said first conveyor means;

means coupling a downstream end of the drive shaft means to an upstream end of the adjustment means associated with said second conveying means; and each adjustment means of said first and second conveying means comprising a linearly movable rod; means coupling adjacent ends of said rods for imparting drive from the movable rod of said first conveying means to the movable rod of said second conveying means.

20. Conveying means comprising first and second conveyor means each including:

a support frame;

a guide plate for aligning signatures slidably engaging said guide plate as they move along the conveyor means;

at least first and second means coupled to said guide plate at spaced intervals therealong for adjusting the position of the guide plate relative to one longitudinal side of its associated conveying means;

rotatable drive means including means for rotating said drive means;

said drive means having a threaded portion;

a movable block having a tapped opening threadedly engaging a threaded portion provided along said drive means for moving said first adjusting means;

a connecting rod coupled to said movable block for imparting movement of said block to said second adjusting means;

said first and second conveyor means being aligned with a downstream end of said first conveying means aligned with and adjacent to an upstream end of said second conveyor means;

a downstream end of the connecting rod provided in said first conveyor means being coupled to an upstream end of the connecting rod provided in said second conveyor means, whereby movement of said connecting rod of said first conveyor means is imparted to the connecting rod of said second conveyor means to operate the adjusting means of said first and second conveyor means substantially simultaneously responsive to operation of said means for rotating said drive means.

21. The conveying means of claim 20 wherein the movable block of said second conveyor means is comprised of first and second block portions;

said first block portion being coupled to said connecting rod;

said second block portion threadedly engaging a threaded portion of said rotatable drive means;

means for selectively coupling said first and second block portions when said second conveyor means is operated independently of said first conveyor means and for decoupling said second block portion from said first block portion to enable movement of said first block portion independently of said second block portion when said first and second conveyor means are coupled together.

22. The conveying means of claim 20 wherein each adjustment means further comprises:

a first linkage arm having one end pivotally coupled to said movable block and a second end pivotally coupled to said guide plate;

a second linkage arm having one end pivotally coupled to said support frame;

a pivot pin coupling said second linkage arm to said first linkage arm.

23. The conveying means of claim 22 wherein the rotatable drive means imparts movement to the movable block of only the first adjustment means, said second adjustment means being moved by the connecting rod coupled between the movable blocks of said first and second adjustment means.

24. The conveying means of claim 20 wherein said adjustment means comprises a linkage assembly having first and second linkage arms coupling movement of its associated movable block to its associated guide plate whereby that guide plate is moved laterally relative to the direction of movement of the conveyor means and is restrained from moving in a direction along its longitudinal axis.

25. The conveying means of claim 1 further comprising means for rotatably supporting said single drive shaft means and for preventing linear movement thereof; and means for rotating said shaft means.

* * * * *